US006990973B2

(12) United States Patent
Puricelli et al.

(10) Patent No.: US 6,990,973 B2
(45) Date of Patent: Jan. 31, 2006

(54) BURNER FOR GAS COOKING RANGES

(75) Inventors: Orio Puricelli, Gallarate (IT); David Ward, Milan (IT)

(73) Assignee: Fulgor Elettrodomestici, S.p.A., Milan (IT)

( * ) Notice: Subject to any disclaimer, the term of this patent is extended or adjusted under 35 U.S.C. 154(b) by 0 days.

(21) Appl. No.: 10/979,456

(22) Filed: Nov. 2, 2004

(65) Prior Publication Data

US 2005/0241631 A1 Nov. 3, 2005

(30) Foreign Application Priority Data

May 3, 2004 (IT) ..... MI2004A0884

(51) Int. Cl.
*A47J 37/00* (2006.01)

(52) U.S. Cl. ..... 126/39 E

(58) Field of Classification Search ..... 126/39 E
See application file for complete search history.

(56) References Cited

U.S. PATENT DOCUMENTS 6,422,231 B1 * 7/2002 Hamilton et al. ..... 126/38

* cited by examiner

*Primary Examiner*—Stephen Gravini
(74) *Attorney, Agent, or Firm*—R. Neil Sudol; Henry D. Coleman; William J. Sapone

(57) ABSTRACT

A gas-fired burner for cooking range, which includes at least one burner, which is arranged below at least one grate on which a cooking vessel is to be arranged, the distance between the nozzles of the burner and the upper surface of the grate being directly proportional to the power of the burner and being inversely proportional to the difference between the temperature of the burner and the temperature of the vessel and to the heat conductivity of the vessel and/or food contained therein.

3 Claims, 1 Drawing Sheet

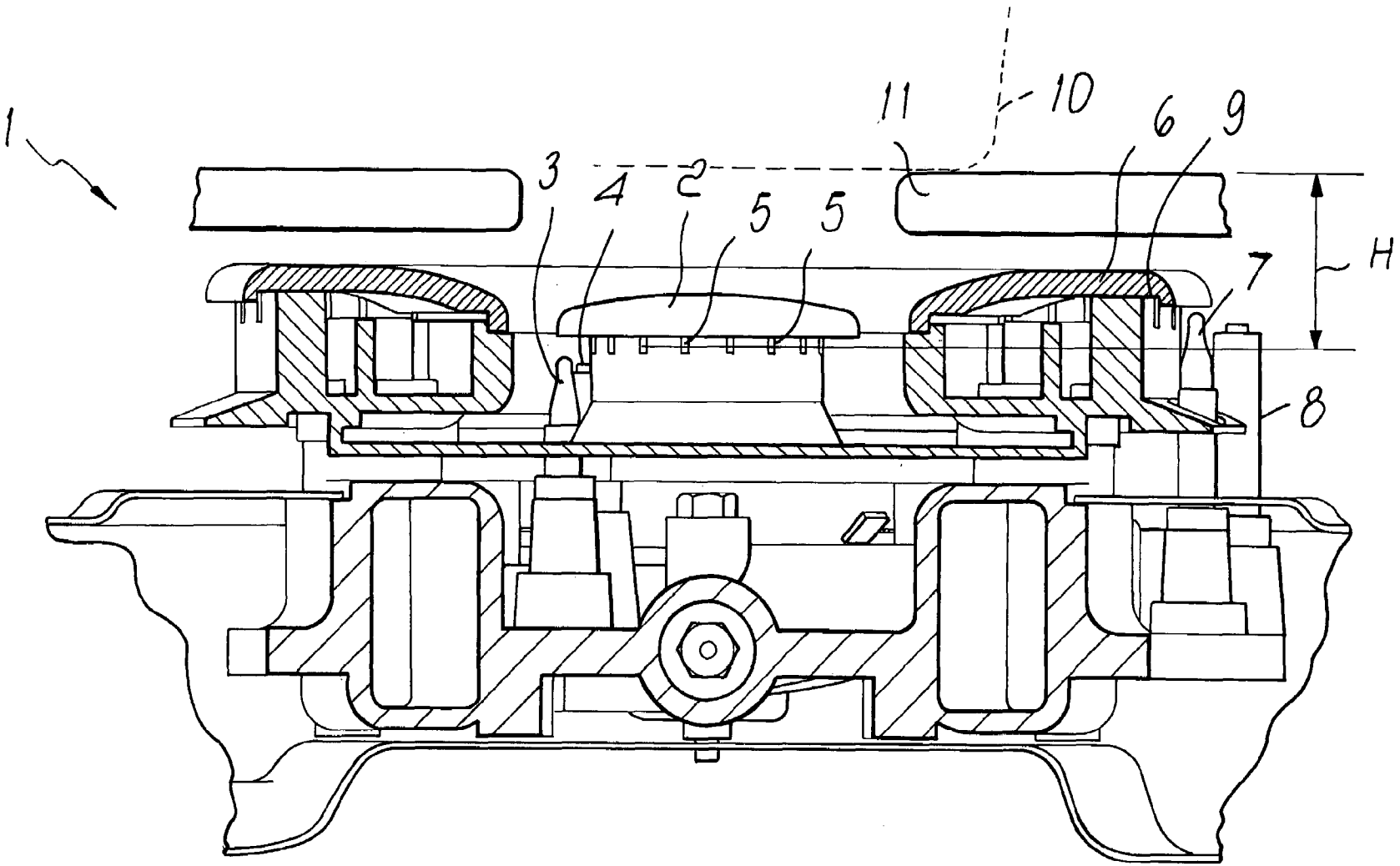
H
8
7
9
6
10
11
5
5
2
4
3
1

BURNER FOR GAS COOKING RANGES

BACKGROUND OF THE INVENTION

1. Field of the Invention

The present invention relates to a highly versatile burner for a gas cooking range.

More particularly, the invention relates to a burner for a gas cooking range normally used in a domestic environment and having a broad operating range.

2. Description of the Prior Art

As is known, gas-fired burners of the single-, double- or triple-ring type are currently available and are designed to provide the greatest possible turn-down ratio while maintaining the maximum and minimum possible heat emissions and providing the highest possible combustion efficiency and pollutant reduction.

In general, gas-fired burners of the Venturi type (also known as atmospheric burners), i.e., burners that operate with primary air aspirated naturally from the environment that surrounds the burner, have a turn-down ratio between 6 and 7. In practice, and by way of example, this entails that standard gas burners with a maximum heat emission of 6000–7000 BTU/h have their minimum possible heat emission set to approximately 1000 BTU/h.

The end user, i.e., the user of the gas burner, perceives the turn-down ratio in terms of ease of use, flame adjustment, flexibility in use, and also as the minimum possible flame that does not cause a flame-out.

Substantially, the end user has the following requirements.

First of all, the heat emission of the burner should be as high as possible (for example 20,000–40,000 BTU/h). This is the most powerful maximum flame, which produces the shortest possible time for heating, boiling, etc.

It is in fact important to heat certain foods very rapidly, so that they do not lose their organoleptic properties; alternatively, this high heat emission requirement arises when, for example, one wishes to boil water in pots that have a thick steel bottom.

Secondly, the burner should have a minimum possible heat emission that is lower than for example approximately 600 BTU/h.

The minimum possible heat emission is used for example when using small pots or coffeepots, or in the case of delicate foods or ingredients, such as chocolate, butter, etc.

It is important to have a broad flame adjustment between the two upper and lower heat emission limits cited above.

Also, flame adjustment must be extremely accurate as regards the possibility to affect the size of the flame.

Also, it is important for the end user that the adjustment that is performed to pass from one flame size to another is such that return to the original flame size occurs with the flame adjustment knob set to the same position used previously (this phenomenon is termed "system hysteresis").

The user must be able to adjust the flame by turning for example the knob to different positions and to return to the initial adjustment by returning the knob exactly to the position in which it was when adjustment began.

In view of the wide variety of sizes and materials used for pots, it would be ideal to have a heated surface area that is large enough to cover any available pot or vessel size.

The aim of the present invention is to provide a gas-fired burner for cooking ranges that is highly versatile and allows to provide the user with a means for reducing the input of heat into the vessel or container arranged on the cooking range, in order to reduce the overheating or burning of delicate foods and at the same time provide fine adjustment of the flame, so as to ensure the maximum possible heat emission from the gas burner.

An object of the present invention is to provide a gas-fired burner for cooking range that allows to have a broad operating range, from a very high heat emission to a very low heat emission, without flame-outs.

A further object of the present invention is to provide a gas-fired burner for cooking range that allows to have a flame adjustment between the upper heat emission limit and the lower heat emission limit that is extremely accurate and precise.

A further object of the present invention is to provide a gas-fired burner for cooking range that allows to have a large heat source surface area.

A further object of the present invention is to provide a gas-fired burner for cooking range that is highly reliable, relatively simple to provide, and at competitive costs.

SUMMARY OF THE INVENTION

This aim and these and other objects that will become better apparent hereinafter are achieved by a gas-fired burner for a cooking range, comprising at least one burner provided with nozzles and arranged below a grate on which a cooking vessel is to be arranged, characterized in that the distance between the nozzles of the burner and the upper surface of the grate is directly proportional to the power of the burner and is inversely proportional to the difference between the temperature of the burner and the temperature of the vessel and to the heat conductivity of the vessel and/or food contained therein.

BRIEF DESCRIPTION OF THE DRAWINGS

Further characteristics and advantages of the invention will become better apparent from the description of preferred but not exclusive embodiments of the gas-fired burner according to the present invention, illustrated by way of non-limiting example in the accompanying drawing, wherein the only figure is a transverse sectional view of the gas-fired burner according to the present invention.

DESCRIPTION OF THE PREFERRED EMBODIMENTS OF THE INVENTION

With reference to the figure cited above, a gas-fired burner according to the present invention, generally designated by the reference numeral 1, comprises a burner 2 with a corresponding thermocouple 3 and an igniter 4. The burner 2 is provided with a plurality of nozzles 5 for emission of the gas to generate the flame.

The figure illustrates a burner configuration with a double ring, in which in addition to the central burner 2 there is an external burner 6, which is likewise provided with a thermocouple 7 and an igniter 8. In this case, the nozzles of the outer burner are designated by the reference numeral 9.

According to the invention, the distance between at least one of the burners 2 and 6 and the bottom of a container 10 arranged on the cooking range and specifically on a grate 11 of the cooking range, which lies above the burner or burners 2 and 6, must be such as to ensure maximum combustion efficiency together with the ability to have a minimum heat emission and a maximum heat emission that are very widely spaced, i.e., the minimum heat emission must be approximately 200 BTU/h and the maximum heat emission must be approximately 20,000 BTU/h. This is equivalent to a turndown ratio of approximately 100.

In particular, if H is the distance between the nozzles 5 of the inner burner 2 and the lower surface of the container 10 in which the food to be cooked or heated is arranged, or as an alternative the upper surface of the grate 11 on which the container 10 is arranged, it is possible to find a relation that links the distance H to the power of the burner, i.e., to heat emission over time, and inversely links it to the temperature relation between the heat source and the container in which the food is placed.

This relation can be expressed for example as $$H = f\left(\frac{P}{k\Delta T}\right)$$

The parameter k indicates the thermal conductivity of the material to which heat is transmitted, i.e., the food, the container, or both.

The distance H is optimum for meeting the requirements listed above when it is at least equal to 10 mm or greater.

In the case of a plurality of burners, as shown in the figure, the inner burner must be arranged downward with respect to the outer burner, i.e., the nozzles 5 of the inner burner 2 must be at a height, with respect to the bottom of the container 10, that is lower than the height at which the nozzles 9 of the outer burner 6 are arranged.

In practice it has been found that the burner according to the present invention fully achieves the intended aim and objects, since it allows, with the previously mentioned distance between the nozzles of the burner and the bottom surface of the container in which the food to be cooked is arranged, to obtain an extremely wide heat emission range, from approximately 200 BTU/h to approximately 20,000 BTU/h.

In the case of a plurality of burners, the inner burner must be arranged at lower height, with respect to the bottom surface of the container, than the outer burner.

In this case also, the distance H is the one cited above.

The burner thus conceived is susceptible of numerous modifications and variations, within the scope of the appended claims. All the details may be replaced with other technically equivalent elements. In practice, the materials used, as well as the shapes and dimensions, may be any according to requirements and to the state of the art.

The invention claimed is:

1. A gas-fired burner for a cooking range, comprising at least one burner provided with nozzles and arranged below a grate on which a cooking vessel is to be arranged, characterized in that the distance between the nozzles of said burner and the upper surface of said grate is directly proportional to the power of the burner and is inversely proportional to the difference between the temperature of the burner and the temperature of said vessel and to the heat conductivity of said vessel and/or food contained therein.

2. The burner according to claim 1, characterized in that said distance is equal to, or greater than, 10 mm.

3. The burner according to claim 1, characterized in that it comprises an additional outer burner, the nozzles of said outer burner being arranged, with respect to the upper surface of said grille, at a higher level than the nozzles of said burner.

* * * * *